United States Patent [19]

Kaieda

[11] Patent Number: 4,960,069

[45] Date of Patent: Oct. 2, 1990

[54] MAGNETIC BRUSH DEVELOPING DEVICE

[75] Inventor: Shozo Kaieda, Nagano, Japan

[73] Assignee: Kentek Information Systems, Inc., Allendale, N.J.

[21] Appl. No.: 324,914

[22] Filed: Mar. 17, 1989

[51] Int. Cl.[5] ..... G03G 15/09

[52] U.S. Cl. ..... 118/657; 355/251; 355/253

[58] Field of Search ..... 118/653, 656, 657, 658; 355/245, 251, 253

[56] References Cited

U.S. PATENT DOCUMENTS

| | | | |
|---|---|---|---|
| 3,113,042 | 12/1963 | Hall | 118/657 |
| 3,246,629 | 4/1966 | Shelffo et al. | 118/658 |
| 3,469,911 | 9/1969 | Olden | 355/245 |
| 4,102,306 | 7/1978 | Ohta | 118/658 |
| 4,417,802 | 11/1983 | Forbes, II | 118/653 X |

FOREIGN PATENT DOCUMENTS

| | | | |
|---|---|---|---|
| 0155845 | 12/1979 | Japan | 355/253 |
| 0140472 | 8/1984 | Japan | 355/253 |

*Primary Examiner*—Fred L. Braun
*Assistant Examiner*—Robert Beatty
*Attorney, Agent, or Firm*—Marmorek, Guttman & Rubenstein

[57] ABSTRACT

A magnetic brush developing device for use in a copying machine or a printing device includes a developing roller forming a magnetic brush, a developer housing, a developer tank outside the developer housing, a scraper for removing developer from the developing roller after it passes through the developing area on the developing roller, a first carrying device in the developer housing arranged opposite to the developing roller along its entire length for carrying the developer from one end to the other end of the developing roller, for supplying developer to the developing roller during the carrying operation, and for discharging the excess developer into a developer tank, a second carrying device in the developer housing arranged parallel to the first carrying device and communicating at one end of the first carrying device for carrying the developer received from the developer tank in a direction opposite to the carrying direction of the first carrying device, for recovering the developer scraped from the developing roller by the scraper, and for supplying developer to the first developer, a third carrying device for supplying the developer accommodated in the developer tank to the second carrying device, and an adjustable height regulating plate provided in a side wall of the developer housing for regulating the height of developer in the developer housing.

15 Claims, 8 Drawing Sheets

FIG.5a
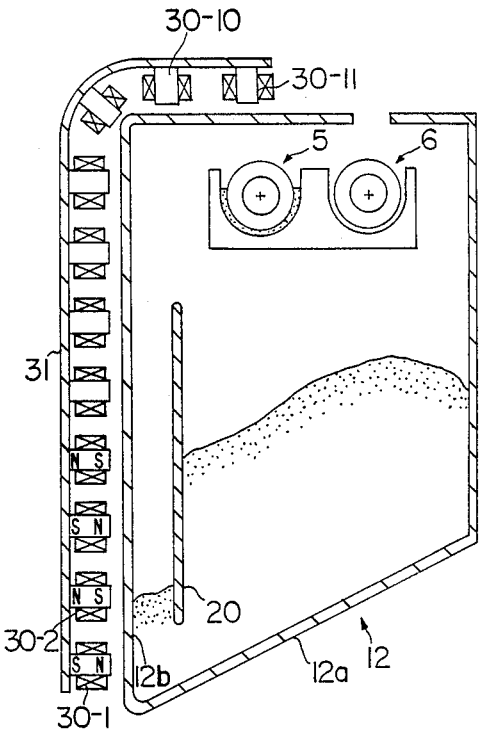
FIG.5b
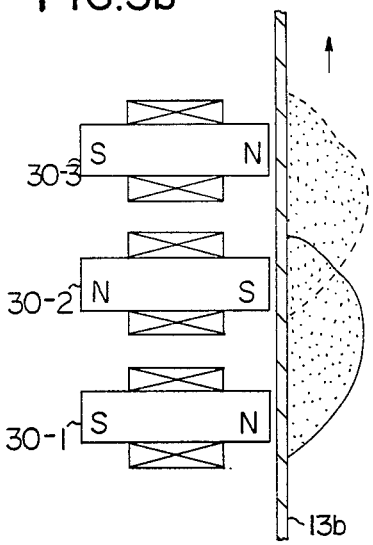
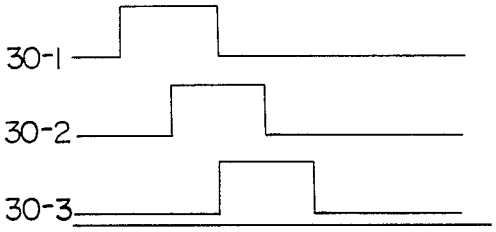
FIG.5c

MAGNETIC BRUSH DEVELOPING DEVICE

BACKGROUND OF THE INVENTION

The present invention relates to a magnetic brush developing device, more particularly, to a device having a developer tank for accommodating developer therein and a developing roller for a magnetic brush.

A magnetic brush developing device is widely utilized as a device for making visible an electrostatic latent image formed on an image forming member such as a photosensitive drum. The conventional magnetic brush developing device is constructed so that toner and magnetic carrier are mixed in a developer vessel or tank to form developer, the developer is applied to a developing roller consisting of a magnet roller and a sleeve of nonmagnetic material to form a magnetic brush, and the magnetic brush is arranged at a position opposite to the photosensitive drum and slidably contacted onto the surface of the photosensitive drum having the electrostatic latent image formed thereon, to form a toner image. It is necessary for the developer to maintain the toner density and the charge on the toner at given values in order to form an image having suitable density. To this end, in the conventional magnetic brush developing device, a stirring device is accommodated in the developer vessel or tank, and during operation the magnetic carrier and toner are mixed and stirred by the stirring device so as to obtain the required toner density and toner charge.

In the above conventional magnetic brush developing device, however, the developer, the developing roller and the stirring device are accommodated in the developer vessel, so that the capacity of the developing vessel must be large. In high speed printing devices and copying devices, particularly, a great amount of developer must be accommodated in the developer vessel, so that the capacity thereof must be very large. As a result of this, the space around the photosensitive drum cannot be utilized effectively, thereby limiting or decreasing the degree of freedom in design.

Moreover, the developer must be exchanged as the deterioration of the developer proceeds. In the conventional developing device, the developer and magnetic developing roller occupy together a large volume in the developer vessel, so that operations for removing the developer from the developer tank in order to exchange the developer becomes troublesome. Moreover, the developer is scattered out of the vessel during the exchange thereof, resulting in a stain on the floor.

In the conventional developing device, moreover, the mixing and stirring of the developer are effected by rotating a stirring roller having a number of stirring blades provided thereto. Such a stirring mechanism serves only to beat the developer by the stirring blades, so that the portions of the developer located at the bottom and the sides of the developer tank are not moved and remain in place and thus only the portions of the developer around the developing roller are utilized for developing. As a result of this, the whole developer in the developer tank is not utilized effectively. In this case, when a part of the developer in the developer tank becomes deteriorated, the whole developer on the image seems to be deteriorated so that the number of exchanges needed for the developer becomes large.

In the conventional magnetic brush developing device, moreover, a mechanism for maintaining the height of the developer surface in the developer vessel or tank for the developing roller is not provided, so that, for example, during operation, the amount of developer supplied to the developing roller is different at both ends of the developing roller. As a result of this the thickness of the magnetic brush becomes uneven, and thus an image having uniform density cannot be obtained.

SUMMARY OF THE INVENTION

It is an object of the present invention to eliminate the above disadvantage of the conventional magnetic brush developing device.

It is another object of the present invention to provide a magnetic brush developing device capable of utilizing the space around the photosensitive body effectively, of exchanging the developer easily, and of utilizing the whole developer in the developer vessel or tank effectively.

It is a further object of the present invention to provide a magnetic brush developing device capable of maintaining the supply of developer to the developing roller over the whole length thereof.

According to the present invention, there is provided a magnetic brush developing device comprising a developing roller for a magnetic brush, a developer tank for accommodating the developer therein, a scraper for removing from the developing roller developer which has passed through the developing area, a first carrying device arranged opposite to the developing roller over its whole length for carrying the developer from one end to the other end of the developing roller, for supplying developer to the developing roller during the carrying operation, and for discharging the non-supplied or non-used developer into the developer tank, a second carrying device arranged parallel to the first carrying device, and communicating at one end thereof with the first carrying device for carrying the developer in a direction opposite to the carrying direction of the first carrying device, and for recovering the developer scraped from the developing roller by the scraper during the carrying operation, and a third carrying device for supplying the developer accommodated in the developer tank to the second carrying device.

The magnetic brush developing device further comprises a height regulating means provided at an exit opening portion of the first carrying device for regulating the height of developer in the first carrying device at a substantially constant level over the whole length of the developing roller.

The height regulating means comprises a height regulating plate capable of attaching at a position which is variable in the vertical direction.

The third carrying device is constituted by a device for carrying the developer by the use of magnetic force.

The third developer carrying device comprises a device for carrying a plurality of permanent magnets from the bottom side to the upper side.

Alternatively, the third developer carrying device comprises a number of electromagnets arranged along side walls of the developer tank from the bottom to an upper portion thereof, and a driving circuit for energizing sequentially the electromagnets from the lowest portion to the upper side in turns.

Toner resupply is performed at the end of the first carrying device at the side of the developer tank, and the resupplied toner and the recover developer are mixed and stirred during the carring operation thereof.

According to the present invention, the developer tank which accommodates the developer therein is separated from the developing device, and is arranged at the side of the developing roller, so that the space between the developing device and the image forming member may be made small. The first carrying device carries the developer to the developer tank from the side opposite to the side at which the developer tank is disposed, and during the carrying operation the developer is supplied to the developing roller and then the non-used or non-applied developer is discharged in the developer tank. The third carrying device, then, supplies the developer in the tank to the entrance portion of the second carrying device, and the supplied developer is carried by the second carrying device to the side opposite to the side at which the tank is disposed. The second carrying device carries the developer from the tank and also recovered developer removed by the scraper from the developing roller. The second carrying device communicates with the first carrying device so as to transmit the developer carried by the second carrying device to the first carrying device. In this manner, the developer in the developer tank is circulated through the first, second and third carrying devices, so that the space around the image forming member may be effectively utilized and the operation for exchanging the developer may be easily performed. By utilizing the magnetic force, the developer recovered in the developer tank is moved to the bottom portion thereof in turn, and the developer positioned at the lowest portion is moved to the upper side in turn in order to resupply the developer to the second carrying device so that the developer is also circulated in the developing tank, thereby preventing a partial deterioration of the developer and improving the lifetime thereof. In one embodiment, a number of electromagnets are arranged along the side wall of the developing tank from bottom to the upper portion, and a part of the developer may be moved from bottom to the upper side by exciting the electromagnets sequentially from the lowest portion to the upper side in turns, so that the carrying performance may be controlled in accordance with the characteristics of the magnetic developer and by controlling magnitude and duration of current pulses. This embodiment can prevent the generation of noise and mechanical faults.

According to the present invention, moreover, the first carrying device for supplying the developer to the developing roller is provided at an exit end thereof with a height regulating mechanism for maintaining the height of the developer surface constant. This height regulating mechanism comprises a vertical exit opening portion formed at the exit side of the first carrying device and a height regulating plate adjustably mounted in the vertical direction so as to cover a part of the vertical exit opening portion. The developer carried by the first carrying device which overflows the upper end of the height regulating plate at the exit opening drops into the developer tank, so that the surface of the developer in the first carrying device corresponds to the level of upper end of the height regulating plate, thereby maintaining the height of the developer surface over the whole length of the developing roller suitably.

BRIEF DESCRIPTION OF THE DRAWINGS

FIGS. 5*a*–5*c* are diagrammatic sectional views and a diagram showing an embodiment for carrying developer from the bottom to the upper side of the developer tank through the use of a plurality of electromagnets;

DETAILED EXPLANATION OF THE PREFERRED EMBODIMENTS

Figure 1B:
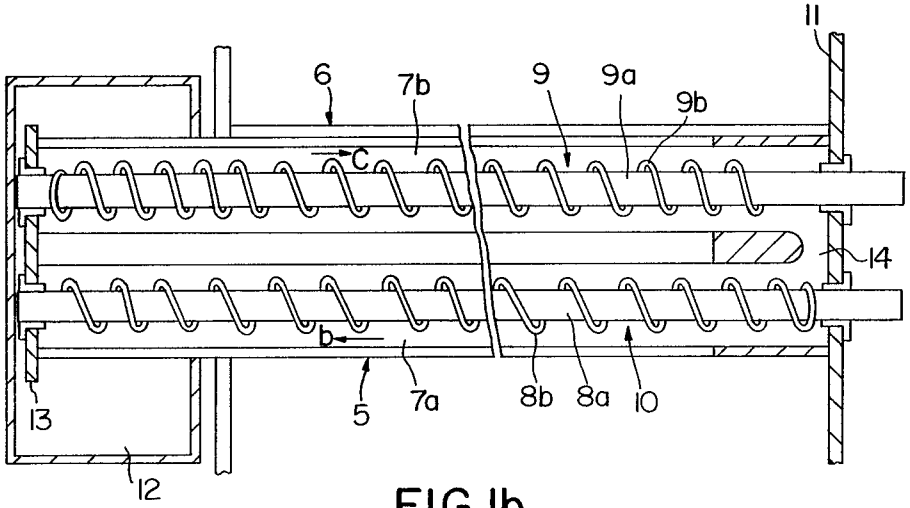
FIGS. 1*a* and 1*b* are a diagrammatic sectional view and a diagrammatic plan view showing the construction of the developing part of a developing device according to the present invention.

Referring now to the drawings, there is shown one embodiment of a magnetic brush developing device according to the present invention.

Figure 1A:
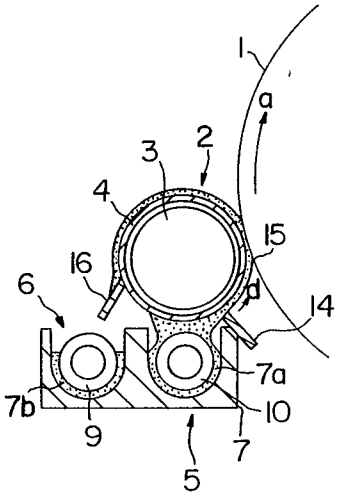
Figure 2:
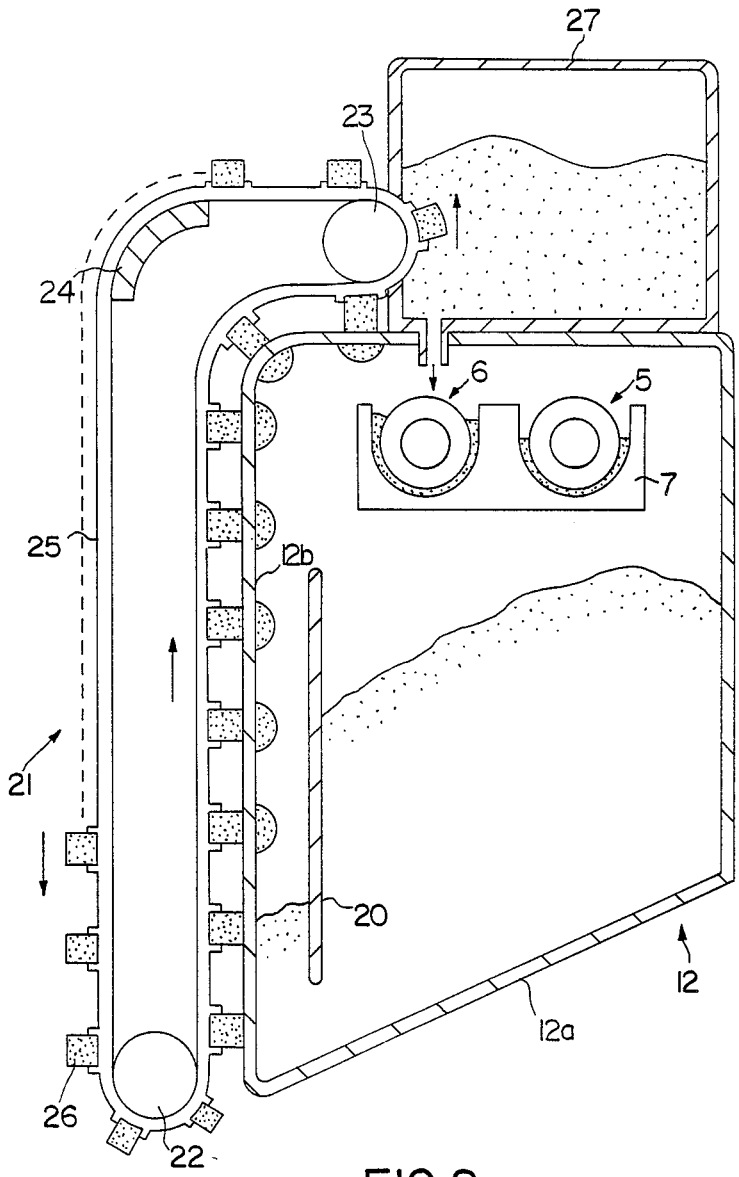
FIG. 2 is diagrammatic sectional view showing the construction of the developer tank part of the developing device according to the present invention.

FIGS. 1*a* and 1*b* show the construction of the magnetic brush developing device according to the present invention. FIG. 1*a* is a sectional view cut at a plane intersected at right angles to the center axis of the developing roller, and FIG. lb is a plan view showing the magnetic brush developing device except for a developing roller, an ear height regulating plate and a scraper. In the present embodiment, a photosensitive drum 1 is utilized as an image forming member and an electrostatic latent image to be developed is formed on the photosensitive drum 1. A developing roller 2 is arranged opposite to the drum 1 which rotates in the direction of an arrow a. The developing roller 2 comprises a cylindrical magnet roller 3 and a hollow cylindrical non-magnetic sleeve 4 arranged on the roller 3 concentrically. The magnet roller 3 has a magnetic force by which magnetic developer is adhered onto the outer peripheral surface of the sleeve 4, thereby forming a magnetic brush. The magnetic developer consists of magnetic carriers and toners. Alternatively, the developer may consist of one-component magnetic toner having magnetic particles. Under the developing roller 2, a first carrying device 5 for supplying the developer to the developing roller 2 is disposed opposite to and parallel to the developing roller 2 and extends over the whole length thereof. Parallel to the first carrying device 5, there is disposed a second carrying device 6 which extends over the developing roller 2 for supplying the developer in a developer tank to the first carrying device 5 and for recovering the developer passed through the developing area. The first and second carrying devices comprise a developer housing 7 having two recesses 7*a* and 7*b*, which extend in parallel with each other, and first and second coil rollers 10 and 9 disposed in these recesses 7*a* and 7*b*, respectively. These first and second coil rollers 10 and 9 have shafts 8*a* and 9*a* as well as coils 8*b* and 9*b* spirally provided on the outer periphery thereof, respectively, and the shafts 8a and 9a are rotatably held by the side plates 11 and 13. A driving device (not shown) coupled to the shafts 8a and 9a rotates the first and second coil rollers 10 and 9 in opposite directions to each other, so that the respective developers in the recesses 7a and 7b are carried in the directions of respective arrows b and c, respectively. A developer tank 12 is provided for accommodating the developer at one end of the longitudinal axis of the developing roller 2. The developer housing 7 and coil rollers 10 and 9 extend into the developer tank 12. The developer accommodated in the developer tank 12 is supplied to an entrance portion of the second carrying device 6 by a developer resupplying device shown in FIG. 2 and the developer carried by the first carrying device is discharged in the developer tank 12. These first and second recesses 7a and 7b formed in the developer housing 7 are in communication with each other at the side opposite to the side at which the developer tank 12 is disposed, so that the developer carried by the second carrying device 6 through a communicating portion 14 may be rapidly carried to the side of the first carrying device 5. The developer supplied to the entrance portion of the second carrying device 6 by the resupplying device shown in FIG. 2 is carried to the side opposite to the developer tank 12 in the recess 7b and then transmitted to the side of first carrying device 5 through the communicating portion 14. Then, the developer is carried to the developer tank 12 by the first carrying device 5, and supplied to the developing roller 2 during the carrying operation, so that the residue developer not—supplied to the developing roller 2 is carried along the recess 7a as it is and then discharged into the developer tank 12. As shown in FIG. 1a, the developer carried in the first carrying device 5 is adhered onto the outer periphery of the sleeve 4 by the magnetic force of the magnet roller 3 during the carrying operation. The height of the adhered developer is regulated by an ear height regulating plate 31, so that a developer layer having uniform thickness over the whole length of the developing roller 2 is formed at the outer periphery thereof. This developer layer is moved along the direction of an arrow d by rotating the magnet roller 3 and/or the sleeve 4 and slidably contacted onto the surface of the photosensitive drum 1 at a developing area 15 opposite to the photosensitive drum 1, and then scraped off from the outer periphery of the sleeve by a scraper 16, thereby being recovered by the second carrying device 6.

FIG. 2 is a sectional view at one end of the longitudinal axis of the developing roller showing the resupplying of the developer in the developer tank to the second carrying device 6. For purposes of clarity in the drawing, the toner resupplying tank is also shown in a sectional view. The plastic developer tank 12 arranged at the side portion of the developing roller 2 for storing the developer therein has a bottom portion 12a being a slanted surface and a partition plate 20 disposed in the tank 12, so that the discharged developer is moved downwardly in turns in the developer tank and is stored on the lowest portion of the bottom and between the partition plate 20 and a side wall 12b of the tank through an opening portion defined by the slanted bottom surface 12a and the partition plate 20. A developer resupplying device 21 is arranged near and adjacent to the side wall 12b outside of the developer tank 12. The developer resupplying device 21 is constituted by a belt 25 arranged about two driving rollers 22 and 23, a guide plate 24, and a number of permanent magnets 26 provided on the outer periphery of the belt 25. The belt 25 and the permanent magnets 26 are moved by the driving force of the driving rollers 22 and 23 along the side wall from the lower portion to the upper portion at a position opposite to the wall 12b of the developer tank 12. The permanent magnets 26 are at first, in a position opposite to the side wall 12b and are gradually elevated along the side wall. At this time, the magnetic carrier is attracted to the permanent magnetic 26 through the side wall by the magnetic force thereof, so that the developer is elevated in a space between the side wall 12b and the partition plate 20 as masses along with the elevation of the permanent magnets 26. When the permanent magnets 26 arrive at the upper portion of the side end portion of the second carrying device 6, the magnets 26 are rapidly moved upwardly along the curvature of the driving roller 23 so that the magnetic force of the permanent magnets 26 acting on the developer becomes decreased rapidly, and thus the developer is dropped downwardly, thereby resupplying the developer to the side end portion of the second carrying device 6. In this case, when the speed of the belt 25 and susceptibility of the permanent magnets 26 are set suitably, the developer in an amount adapted for use at the developing roller 2 may be resupplied continuously.

In this manner, two separated spaces are defined in the developer tank 12 by the partition plate 20a. These spaces are communicated with each other at the lowest portion of the developer tank 12 and the bottom surface 12a of the tank 12 is made as a slanted surface, so that the whole developer recovered in the tank is moved gradually to the lowest portion of the tank. In this way, the construction thus obtained prevents the developer from staying in the developing tank, so that the partial deterioration of the developer may be prevented. As a result of this, the lifetime of the developer may be prolonged and the number of exchanges of the developer may be decreased.

In order to maintain the toner density of the developer, a toner resupplying tank 27 is arranged near the center portion of the developer resupplying device 21 on the developer tank 12, so that toner resupplying may be performed according to the consumption amount of toner. As the toner resupplying device, many kinds of conventional toner resupplying device may be utilized, so that its detailed explanation is omitted. The toner resupplied from the toner resupplying tank 27 is dropped onto the entrance portion of the second carrying device 6, to carry such toner together with the developer resupplied from the developer resupplying device 21 into the recess 7b. During the carrying operation, the resupplied toner, the developer resupplied from the developer tank and the developer recovered from the developing roller 2 are mixed and stirred with each other, so that the developer having the given toner density and the toner charge is formed.

Figure 3:
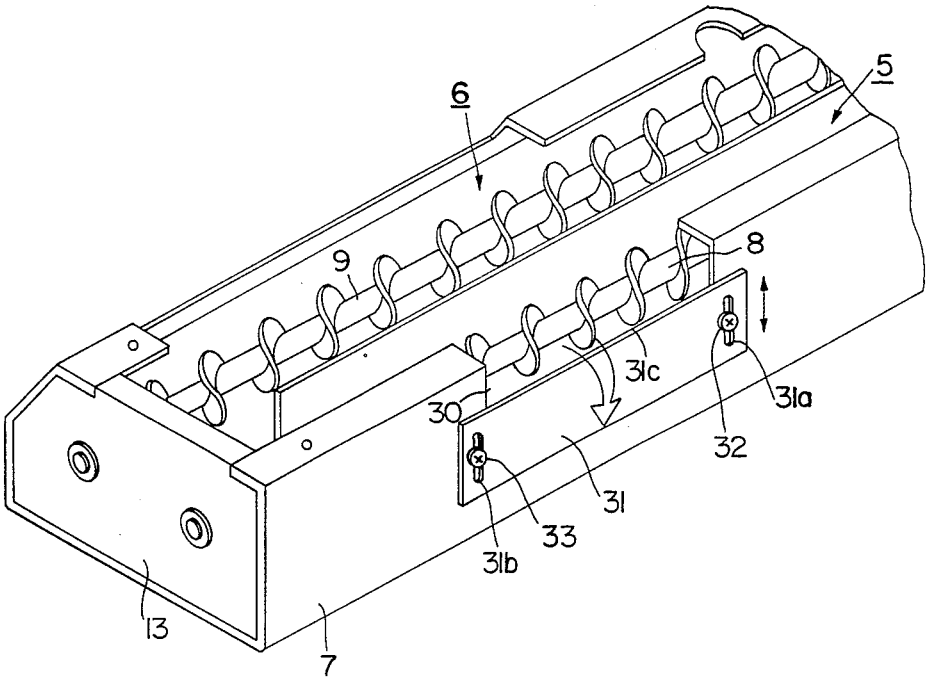
FIG. 3 is a perspective view showing the construction of a height regulating mechanism for regulating the height of the developer surface.

FIG. 3 is a perspective view showing the construction of one embodiment of a height regulating mechanism for maintaining at a constant level the height of developer in the first carrying device. When the height level of the developer in the first carrying device 5 is changed, the amount of developer supplied to the developing roller 2 also becomes changed, so that a magnetic brush of uniform thickness cannot be obtained. In this case, if the amount of the developer supplied to the second carrying device 6 corresponds to the amount discharged to the developer tank 12 by the first carrying device 5, the height of the developer level in the first carrying device 5 may be maintained constant. However, it is difficult to coordinate the amount supplied with the amount discharged precisely, so that, if the discharged amount is larger than the supplied amount of the developer, the developer level supplied to the developing roller by the first carrying device 5 becomes gradually decreased from the discharging side, resulting in a decrease of image density on the record paper at the discharging side. According to the present invention, there is provided a height regulating mechanism for maintaining at a constant level the height of the developer present in the first carrying device 5. As shown in FIG. 3, an opening portion 30 is provided in the side wall at the exit side of the first carrying device 5 in the developer housing 7, and a height regulating plate 31 is attached so as to cover a part of the lower end of the opening portion 30. The height regulating plate 31 is provided with two long holes 31*a* and 31*b*, so as to attach the height regulating plate 31 to the developer housing 7 by screws 32 and 33 through the long holes 31*a* and 31*b*. Since the exit end of the first carrying device 5 is closed by the side plate 13, the developer carried to the developer tank by the coil roller stays at the exit end portion, and thus the height of the developer becomes increased gradually. When the developer level is higher than an upper end 31*c* of the height regulating plate 31 attached to the exit opening portion 30, the developer overflows the height regulating plate 31 and falls into the developer tank 12. In this case, only the developer exceeding the height of the upper end of the height regulating plate 31 overflows the exit opening portion 30, so that the height level of the developer present in the first carrying device 5 over its whole length corresponds to the height of the upper end of the height regulating plate 31, and thus the height level of the developer in the carrying device may be maintained constant by the height regulating plate 31. Since the height regulating plate 31 may be adjusted in the vertical direction, even though the attached position in the vertical direction of the developer housing 7 to the developer roller 2 is shifted more or less, the height level of developer supplied to the developing roller 2 by the first carrying device 5 may be adjusted suitably by adjusting the attached position of the height regulating plate 31 in the vertical direction.

Next, the operation of exchanging the developer is explained. In order to exchange the developer, the developer resupplying device 21 is stopped and only the developing roller 2, the first carrying device 5 and the second carrying device 6 are operated. Then, the developer adhered onto the outer periphery of the developing roller 2 is recovered in the second carrying device 6 by the scraper 16, and the developer in the carrying device is carried through the communicating portion and accumulated in the developer tank 12. Then, only the developer tank is removed from the device, and the developing tank in which new developer is placed, is attached, so that the developer may easily be exchanged.

Figure 4:
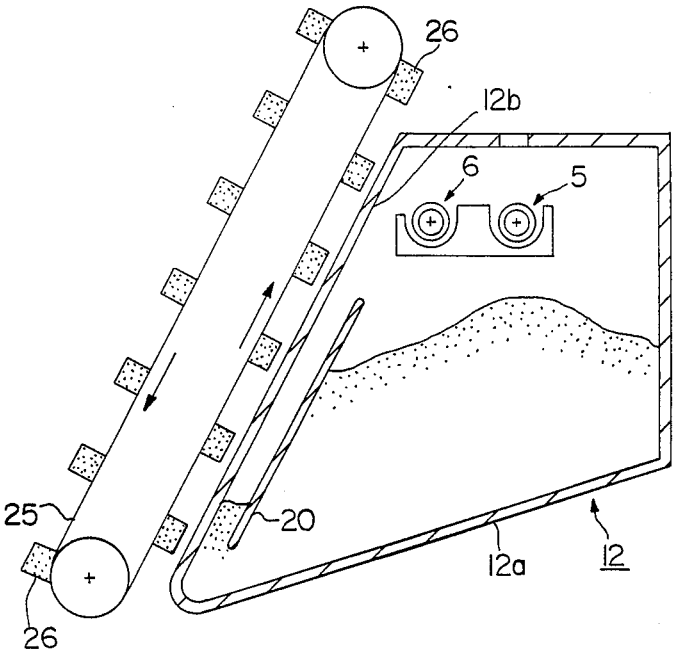
FIG. 4 is a diagrammatic sectional view showing the construction of a modification of the developer tank part of the developing device according to the present invention.

In the above described embodiment, permanent magnets of square rod shape are carried by the belt, but cylindrical permanent magnet rotatably carried by a belt or a chain may also be used. Thus cylindrical magnets may also be carried by rotating them along the side wall of the tank. In this case, the permanent magnets may be carried or moved rapidly without generating noise. As shown in FIG. 4, the side wall 12*b* of the developer tank 12 may be a slanted surface, and a number of permanent magnets may also be carried along the slanted surface. In this manner, the carrying route of the permanent magnets 26 may be straight and the carrying mechanism of the permanent magnet may be simplified. Instead of the fact that a number of permanent magnets are moved by the belt, the belt itself may be constituted by a permanent magnet, and this belt may be carried from the lowest portion to the upper portion.

Figure 6:
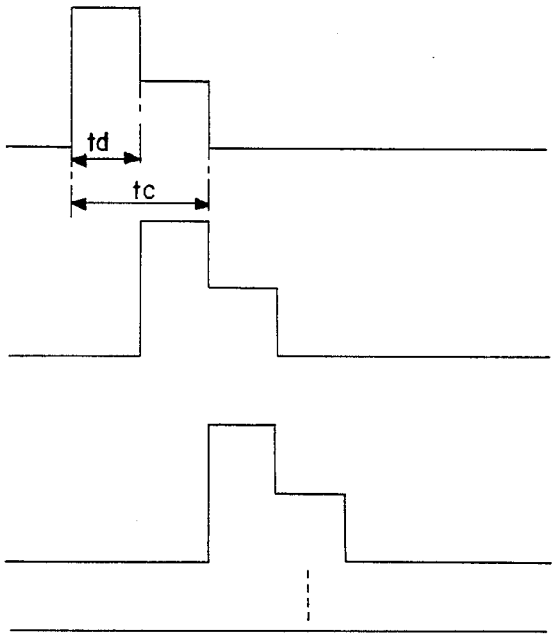
FIG. 6 is a diagram showing a modification of the current pulse supplied to the electromagnets.

FIG. 5 shows the construction of a modification of the developer resupplying device. In this embodiment, the resupplying of the developer is performed by a number of electromagnets, instead of permanent magnets that are carried. In FIG. 5, parts similar to those previously described with reference to FIG. 2 are denoted by the same reference numerals. In this embodiment, eleven electromagnets 30–1 - 30–11 are arranged at a given pitch along the outer periphery of the side wall 12*b* of the developer tank 12, and these electromagnets 30–1 - 30–11 are secured to a holding plate 31. Each electromagnet has a yoke and a coil, and each coil is wound so as to generate a magnetic pole on the side wall 12*b* and a side opposite thereto. As shown in FIG. 5*b*, the current is supplied to each electromagnet in such a manner that the magnetic poles of the electromagnets adjacent to each other are different and have opposite magnetic poles to each other. FIG. 5*c* shows shapes of current pulses supplied to adjacent electromagnets, respectively. In this case, the current pulses supplied to respective electromagnets adjacent to each other in turn have the same durations with supplying periods overlapped by 50%, so that in case of exciting the electromagnets 30-1 and 30-2 as shown in FIG. 5*b*, the developer is gathered in a mass at the corresponding position between these magnetic poles, and then if the electromagnet 30-1 is deenergized and the electromagnet 30-3 is energized, the mass of developer is moved to a position between magnetic poles of the electromagnets 30-2 and 30-3. If these electromagnets are arranged in turn along the side wall of the developer tank and excited or energized in succession from lowest side to uppermost side, the magnetic developer may be moved in turn from the lowest side to the uppermost side. If the last electromagnet is positioned over the second carrying device 6, the developer may be resupplied to the second carrying device 6, successively, by deenergizing the last electromagnetic 30-11. In this case, when the mass of developer is moved to the position corresponding to the adjacent electromagnets by exchanging the current pulses, some developer is dropped back into the tank, but the dropped amount of developer is not a serious problem, since the developer is consecutively supplied in chain fashion by the magnetic carriers being magnetized in the magnetic field. In this case, if the amount of supplying current and the current pulse periods are selected suitably, the required amount of the developer may be resupplied consecutively. The utilization of such an electromagnet arrangement prevents noise and mechanical faults from being generated. The strength of the generated field may be controlled by adjusting the amount of supplying current, so that the carrying performance of the developer may be controlled according to the properties of the magnetic carrier being used. In order to decrease the dropped amount of the developer and to secure the carrying or movement of the developer, a current pulse having the waveform shown in FIG. 6 may be supplied in turn. As shown in FIG. 6, when the current waveform has a large value at the first half portion thereof, a large magnetic field is generated at the instant of switching and thus the developer is rapidly moved upward, so that the dropped amount of the developer is decreased.

Figure 7:
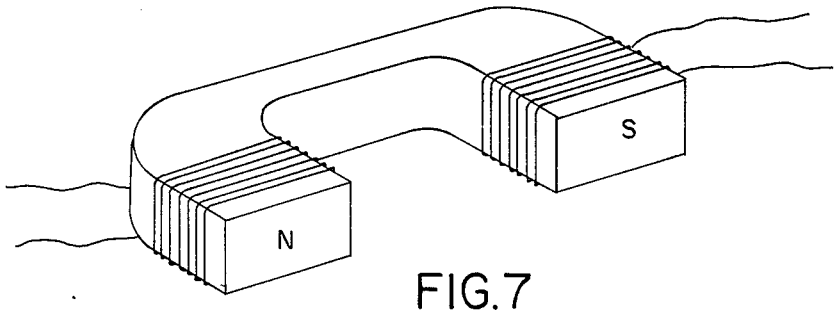
FIG. 7 is a perspective view showing the construction of the electromagnets.

As shown in FIG. 7, the electromagnet may be so constructed that a U-shaped core is used, and a coil is wound to form magnetic poles having opposite polarities with each other at both ends of the core. The utilization of such a U-shaped core will generate two effective poles by one electromagnet so that the magnetic flux may be utilized more effectively and the amount of supplying current may be decreased.

Figure 8:
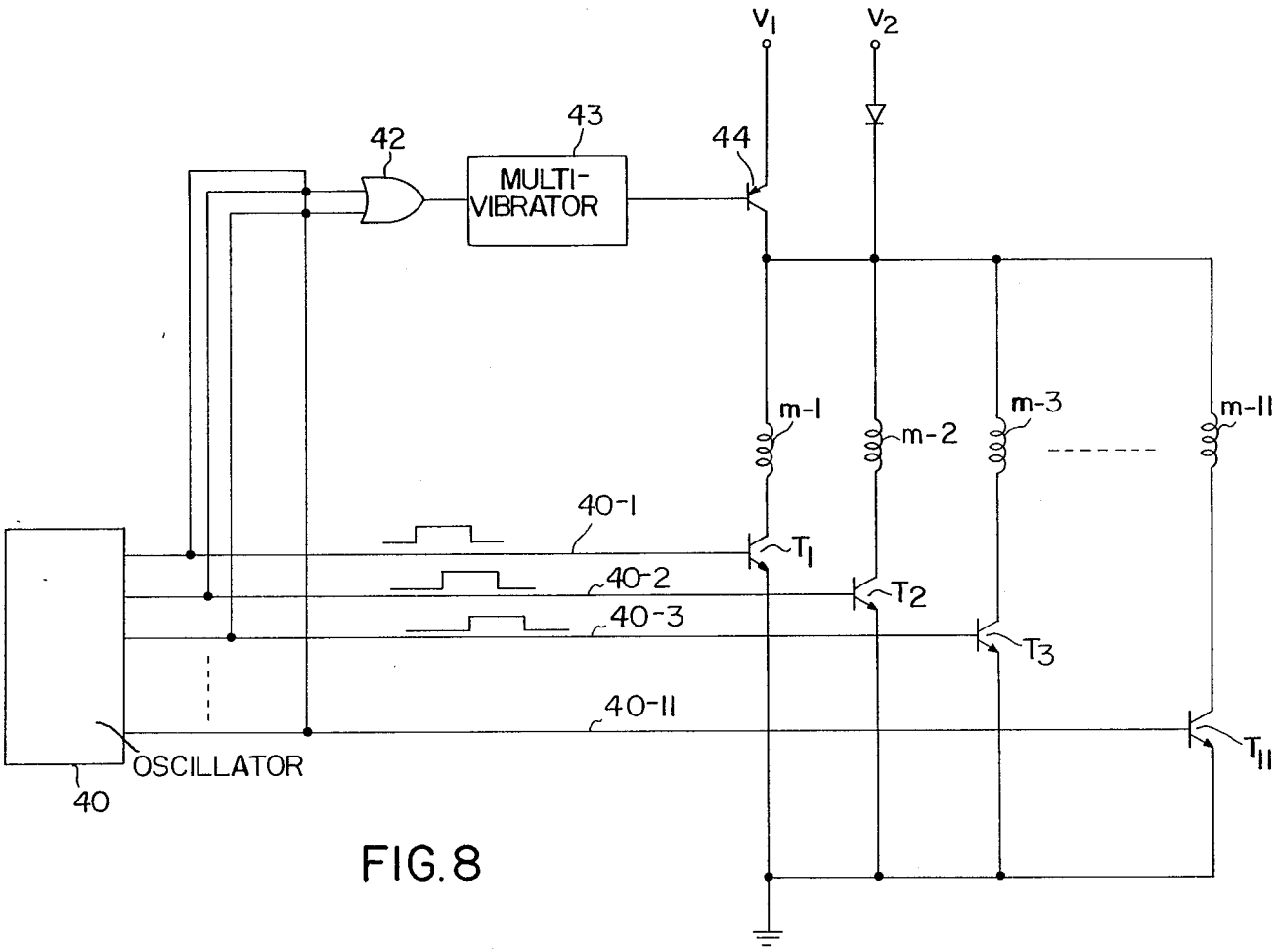
FIG. 8 is a circuit diagram showing the construction of an electromagnet driving circuit.

FIG. 8 shows the construction of one embodiment of a driving circuit for the electromagnets. The clock signals each having its duty overlapped by 50%, are supplied to lines 40-1 to 40-11 from an oscillator 40, respectively. The duration of respective clock signals corresponds to the exciting period of an electromagnet. Respective clock signals are supplied to an 0R gate 42 to put a monostable multivibrator 43 in an ON state at the leading edge of each clock pulse. In this embodiment, a current pulse having the waveform shown in FIG. 6 is supplied to respective electromagnets m-1 - m-11, and the operating period of the monostable multivibrator is set to $t_\delta$. The output terminal of the monostable multivibrator 43 is connected to the base of a transistor 44. The transistor 44 has an emitter connected to a driving voltage source $V_1$ for generating driving current for electromagnets m-1 - m-11 and a collector connected to one terminal of a respective coil of respective electromagnets m-1 - m-11. A second driving voltage source $V_2$ for generating current pulses having a second half portion of low driving current is connected to the above described terminal of the respective electromagnets through a diode. The other terminals of respective coils of respective electromagnets are connected to collector terminals of transistors $T_1$ - $T_{11}$, respectively. Respective transistors $T_1$ - $T_{11}$ have base terminals connected to 40-1 - 40-11, respectively, and emitter terminals connected to ground. At first, when the oscillator 40 generates a first clock signal for driving first electromagnet m-1, the monostable multivibrator 43 becomes ON over a period $T_\delta$ through the OR gate 42, thereby rendering the transistor 44 ON. The base of the transistor $T_1$ receives the clock signal through the line 40-1, thereby rendering the transistor $T_1$ ON. As a result, the driving current is supplied to the first coil $m_1$ from the first driving voltage source, and after the period $T_\delta$ the monostable multivibrator 43 becomes OFF, but the second driving voltage source $V_2$ generates a driving current having a low value at the second half portion thereof over the period $T_c$, so that a current pulse having the waveform shown in FIG. 6 is supplied to the first coil $m_1$. Then, the oscillator 40 generates a clock pulse for driving the second coil $m_2$, thereby exciting or energizing the second coil $m_2$. In this manner, the first and the second coils $m_1$ - $m_2$ are driven by supplying and energizing the current pulses, in turns.

Figure 9:
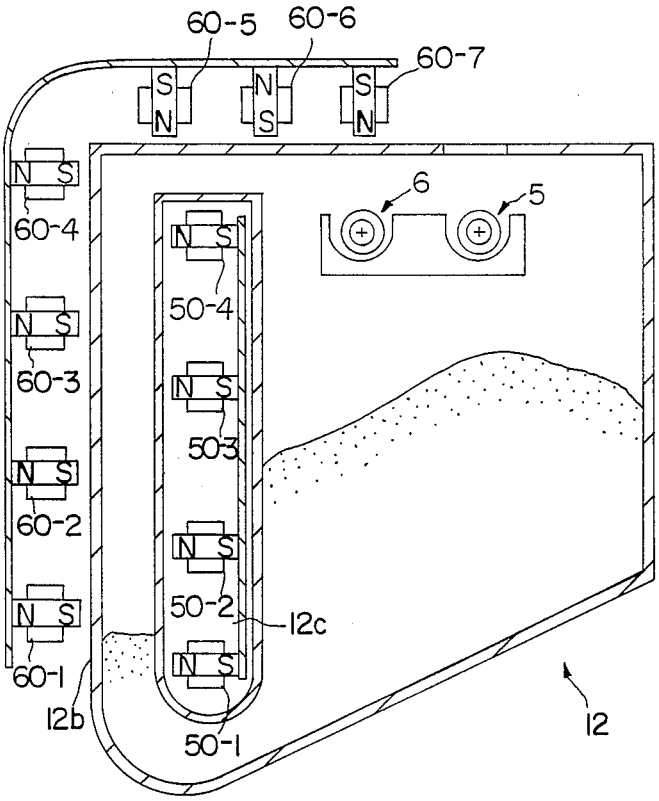
FIG. 9 is a diagrammatic sectional view showing the construction of a modification of the developer resupplying device comprising a plurality of electromagnets.

FIG. 9 shows the construction of another modification of the developer resupplying device 12. In this embodiment, in order to decrease the dropped amount of the developer, two lines of electromagnets may be arranged in staggered fashion with each other. To this end, one line of electromagnets are arranged outside the side wall **12*b*, and the other line of electromagnets are arranged in a space 12*c* which is located on the other side of the side wall 12*b* in the developer tank 12. Respective lines of electromagnets are arranged opposite to each other in zigzag manner. Current pulses are supplied according to the order of an electromagnet 50-1, an electromagnet 60-1, and electromagnet 50-2, an electromagnet 60-2,..., in such a manner that respective opposite magnetic poles of electromagnets adjacent and opposite to each other become opposite polarities. In this manner, at first electromagnets 50-1 and 60-1 are energized, secondly electromagnets 60-1 and 50-2 are energized, thirdly electromagnetics 50-2 and 60-2** are energized, and so on. Respective two electromagnets are energized to have polarities opposite to each other, so that the generated magnetic field is focused upwardly and diagonally, thereby utilizing the magnetic flux effectively. In this case, if the width of the developer carring path defined between electromagnet lines is set small enough, the strength of the magnetic field formed therebetween may be increased so that the amount of current supplied may be decreased.

I claim:

1. A magnetic brush developing device for an electrophotographic printing machine, comprising a developing roller forming a magnetic brush, a scraper associated with said developing roller for removing residual developer from said developing roller, a developer housing, a developer tank for accommodating recycled developer therein, said developer tank being disposed outside said developer housing, first developer carrier means disposed within said developer housing opposite to said developing roller for carrying developer along its entire length, for supplying developer to said developing roller during said carrying operation, and for delivering excess toner to said developer tank through an opening in said developer housing, second developer carrying means disposed within said developer housing parallel to said first developer carrying means and communicating with said first developer carrying means in said developer housing for carrying developer from said developer tank in a direction opposite to the carrying direction of said first developer carrying means, for recovering developer scraped from said developing roller by said scraper, and for delivering developer to said first developer carrying means, and third developer carrying means associated with said developer tank for supplying recycled developer accommodated in said developer tank to said second developer carrying means.

2. The magnetic brush developing device of claim 1 wherein said developer housing comprises a bottom, vertical side walls, and a top, said top having an opening through which said first and second developer carrying means communicate with said developing roller, said first and second developer carrying means being completely located within said developer housing, said opening in said developer housing being located in a side wall adjacent said developer tank.

3. The magnetic brush developing device of claim 2 further comprising height regulating means associated with said first developer carrying means for regulating the height of developer in said developer housing so that said height is substantially constant along the entire length of said first developer carrying means.

4. The magnetic brush developing device of claim 3 wherein said height regulating means comprises an adjustable plate located in said opening of said side wall of said developer housing, the height of said plate within said opening being adjustable.

5. The magnetic brush developing device of claim 1 wherein said developer tank is located below and outside said developer housing at a location near an exit end of said first developer carrying means.

6. The magnetic brush developing device of claim 1 wherein said developer tank comprises a bottom and side walls, said bottom being slanted downwardly, said third developer carrying means being located outside said developer tank and at a position opposite to the lowest point of said developer tank.

7. The magnetic brush developing device of claim 6 wherein said third carrying means is disposed parallel to a side wall extending to the lowest point of said developer tank.

8. The magnetic brush developing device of claim 7 wherein said developer tank includes a partition located within said tank and parallel to said side wall extending to the lowest point of said developer tank.

9. The magnetic brush developing device of claim 8 wherein said side wall extending to the lowest point of said developer tank is vertical.

10. The magnetic brush developing device of claim 8 wherein said side wall extending to the lowest point of said developer tank is slanted.

11. The magnetic brush developing device of claim 11 wherein said third developer carrying means comprises magnetic carrying means located outside said developer means.

12. The magnetic brush developing device of claim 11 comprising a plurality of permanent magnets disposed on endless belt means for carrying said plurality of permanent magnets from the lowest point of said developer tank to an upper portion of said developer tank.

13. The magnetic brush developing device of claim 11 wherein said third developer carrying means comprises a plurality of electromagnets arranged along a side wall extending to the lowest portion of said developer tank, and means for sequentially energizing said electromagnets from the lowest portion of said developer tank to an upper portion of said developer tank.

14. The magnetic brush developing device of claim 13 comprising a first set of electromagnets arranged outside said developer tank and a second set of electromagnets arranged within said developer tank.

15. The magnetic brush developer device of claim 11 further comprising toner resupply means located near an opening through which said second developer carrying means receives recycled developer from said developer tank, said developer received from said developer tank and said toner received from said toner resupply means being mixed during the carrying operation of said second developer carrying means.

* * * * *